US010767955B2

(12) United States Patent
Uhr

(10) Patent No.: US 10,767,955 B2
(45) Date of Patent: Sep. 8, 2020

(54) DEVICE, SYSTEM AND METHOD FOR SIMULATED FIREARM TRAINING

(71) Applicant: LASER AMMO LTD., Great Neck, NY (US)

(72) Inventor: Oren Uhr, Rishon Lezion (IL)

(73) Assignee: LASER AMMO LTD., Great Neck, NY (US)

( * ) Notice: Subject to any disclaimer, the term of this patent is extended or adjusted under 35 U.S.C. 154(b) by 0 days.

(21) Appl. No.: 16/746,890

(22) Filed: Jan. 19, 2020

(65) Prior Publication Data

US 2020/0166306 A1 May 28, 2020

Related U.S. Application Data

(63) Continuation of application No. 15/400,393, filed on Jan. 6, 2017, now Pat. No. 10,563,948.

(60) Provisional application No. 62/276,476, filed on Jan. 8, 2016.

(51) Int. Cl.
*F41A 33/02* (2006.01)

(52) U.S. Cl.
CPC ..... *F41A 33/02* (2013.01)

(58) Field of Classification Search
CPC ..... F41A 33/00; F41A 33/02; F41A 33/04; F41A 33/06; F41G 3/26
See application file for complete search history.

(56) References Cited

U.S. PATENT DOCUMENTS 8,734,156 B2 * 5/2014 Uhr ..... F41A 35/00 434/19
9,170,079 B2 * 10/2015 Moore ..... F42B 12/42
2006/0265929 A1 * 11/2006 Haney ..... F41G 3/2655 42/116

* cited by examiner

*Primary Examiner* — Timothy A Musselman
(74) *Attorney, Agent, or Firm* — Mark David Torche; Patwrite Law

(57) ABSTRACT

A laser projection insert including a laser module disposable in the chamber of a simulative training firearm. An activation cap includes a printed circuit board and a photo sensor disposed on the printed circuit board. The photo sensor is configured to receive an optical signal from the simulative training firearm. The activation cap is configured to control the laser module to emit light. A power source is disposed between the activation cap and the laser module. A first part of the power source is positioned on the activation cap and a second part of the power source is positioned on the laser module.

12 Claims, 20 Drawing Sheets

DEVICE, SYSTEM AND METHOD FOR SIMULATED FIREARM TRAINING

CROSS REFERENCE TO RELATED APPLICATIONS

This application is a continuation of U.S. patent application Ser. No. 15/400,393, filed on Jan. 6, 2017 and entitled "Device, system and method for simulated firearm training", which claims priority to U.S. Provisional Patent Application No. 62/276,476, filed Jan. 8, 2016, the disclosures of which are incorporated by reference herein in their entirety.

FIELD OF THE INVENTION

The present invention relates to a device, system and method for simulated firearm training. More particularly, the present invention relates to a device, system and method for simulated firearm training employing a modular, self-contained laser projection system removably disposed in a barrel of a simulative training firearm without being physically wired or electrically connected to the simulative training firearm. The device, system and method according to an exemplary embodiment of the present invention may be used with a variety of handheld firearms, such as a training pistol and for detecting and recording when laser fire or optical signals strike a target in a simulative fire training system or a simulative fire target system.

BACKGROUND OF THE INVENTION

Simulated firearm training may include repeated firing without ammunition, such as by firing a laser beam or a light signal at a target such as a light detection system. Simulative fire allows individuals to improve shooting techniques without employing bullets. It may be desirable to have a device and method in which a single or multiple users, or trainers and trainees can readily practice using a firearm without placing themselves or others at risk of accidental discharge of a bullet while still maintaining the ability to recognize whether a firearm has been fired accurately at a target. Simulated firearm training, such as using a training pistol or a simulative training gun firing a laser beam at a target, may limit the financial burden related to the wear and tear on a traditional firearm, including the cost of ammunition and use of adequate facilities brought about by live fire training. For example, simulated firearm training may be employed to develop and improve muscle memory of a shooter without the safety issues and costs associated with life fire training exercises.

Simulated firearm training may be useful to law-enforcement member, military personnel and recreational firearm users who desire a relatively high degree of firearm practice and proficiency. Live fire training may pose a heightened risk to users, such as when the muzzle of a firearm points toward other users, increasing the likelihood of accidental and potentially fatal discharge. Training Officers (TOs) may be injured or fatally wounded during live fire exercises or during loading/unloading procedures of a live fire weapon or firearm. For example, a live round may reach the chamber of a firearm without an officer being aware that he or she is facing a loaded weapon.

Detecting the accuracy of a shooter in a live fire training exercise may be less accurate than detecting accuracy using a laser detection/simulation scenario. For example, when multiple shooters participate in a live fire training exercise using substantially identical bullets fired at a same target, it may be difficult to determine which of the multiple shooters contacted the target. Additionally, when a single shooter hits substantially a same point on a target multiple times during a live fire training exercise it may be difficult to detect which location on the target the shooter contacted, or how many times each particular location on the target was hit. Thus, a simulative fire training device may be used to more reliably detect the shooting accuracy of multiple shooters using a single target.

A simulative fire training device may be inserted into a barrel of a training firearm and may be activated upon receiving a signal from the simulative training firearm. The simulative fire training device may emit light, such as infrared (IR), ultraviolet (UV) or visible light to a target upon receiving the signal. Thus, it may be desirable to have a modular, self-contained laser projection system removably disposed in a barrel of a simulative fire training firearm without being physically wired or electrically connected to the simulative fire training firearm.

SUMMARY OF THE INVENTION

Exemplary embodiments of the present invention may provide a multi-function, modular, laser insert disposable in the chamber of a training firearm. The laser insert may include an illuminator (e.g., a laser module), which upon receiving an optical command from a simulative training firearm light emitting device, emits a beam of at least one wavelength of visible and/or invisible illumination from the barrel of the simulative training firearm toward a target.

The beam of light emitted from the laser module may be substantially parallel to a central axis of the training firearm, and a laser insert according to exemplary embodiments of the present invention may include adjustment screws (e.g., elevation and windage screws) adjustable for maintaining the parallel path of the emitted light. The adjustment screws may connect the laser module to a retainer disposable in the simulative training firearm, and may adjust the path of the light emitted by the laser insert to maintain firing accuracy.

The laser insert according to an exemplary embodiment of the present invention may include a power source (e.g., a battery) providing power (e.g., DC power) to an activation cap and the laser module.

The beam of light emitted from the laser insert according to an exemplary embodiment of the present invention may include at least one wavelength of infrared (IR), ultraviolet (UV) or any desired wavelength of light, such as any desired wavelength of visible light.

The modular components (e.g., the activation cap and the laser module) may be selectively replaced and thus different functionality may be achieved without replacing the entire laser insert. The modular components may be employed to generate unique user identification patterns and may be adaptable for use with substantially any simulative fire training or target system.

The laser insert may include a retainer including an attachment part configured to couple the laser insert to the barrel of the simulative training firearm without physically wiring or electrically connecting the laser insert to the simulative training firearm. The laser insert may communicate optically with the simulative training firearm.

BRIEF DESCRIPTION OF THE DRAWINGS

The above and other features of the present invention will become more apparent by describing in detail exemplary embodiments thereof, with reference to the accompanying drawings in which.

DETAILED DESCRIPTION OF THE INVENTION

Figure 1:
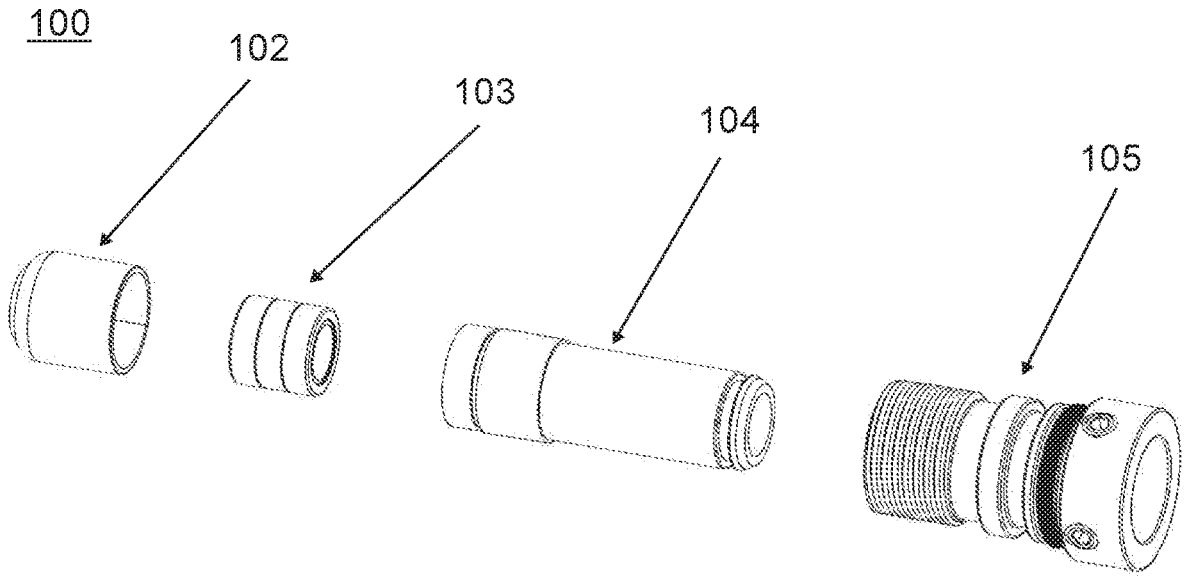
FIG. 1 illustrates a laser insert including a modular activation cap, power source, laser module and retainer according to an exemplary embodiment of the present invention.

Exemplary embodiments of the present invention may provide a device, system and method for simulated fire training. Exemplary embodiments of the present invention may provide a device, system and method for simulated fire training employing a modular, self-contained laser projection system removably disposed in a barrel of a simulative fire training firearm without being physically wired or electrically connected to the simulative training firearm. The device, system and method according to an exemplary embodiment of the present invention may be used with a variety of handheld firearms, such as a training pistol or another simulative training firearm. The device, system and method according to exemplary embodiments of the present invention may detect and record when laser fire strikes a target in a simulative fire training system.

Exemplary embodiments of the present invention may provide a multi-function, modular, laser insert disposable in the chamber of a simulative training firearm. The laser insert may include an illuminator (e.g., a laser module—described below in more detail), which upon receiving an optical command from a simulative training firearm light emitting device, emits a beam of at least one wavelength of visible and/or invisible illumination from the barrel of the simulative training firearm.

Exemplary embodiments of the present invention will be described in more detail below with reference to the accompanying drawings. Like reference numerals may refer to like elements throughout the specification and drawings.

Figure 2:
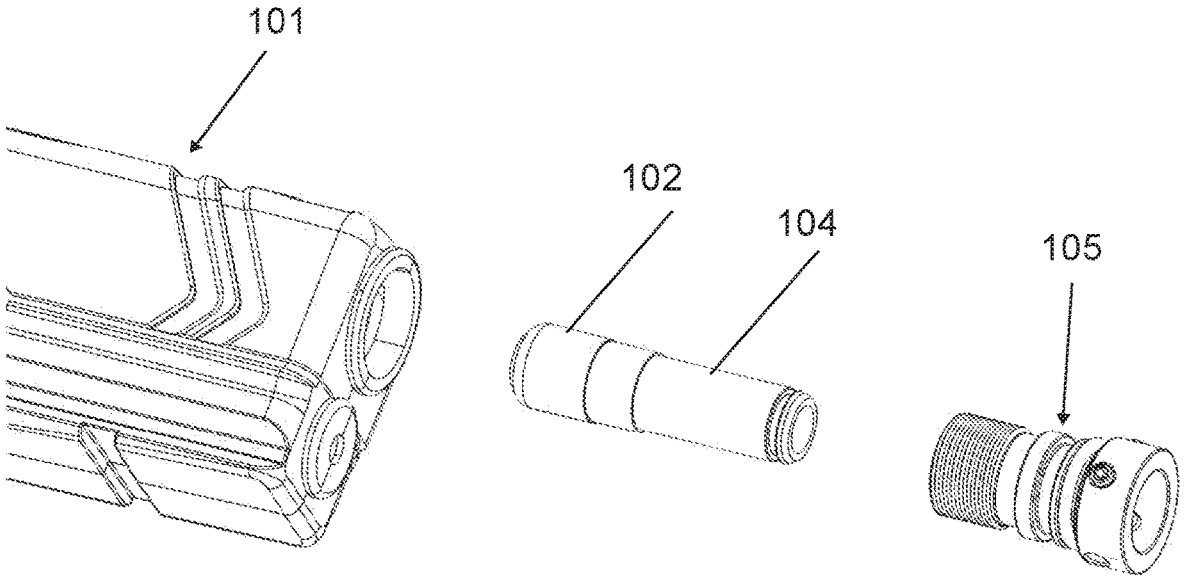
FIG. 2 illustrates a laser insert including a laser module coupled to an activation cap and a power source, and a retainer according to an exemplary embodiment of the present invention.
Figure 3:
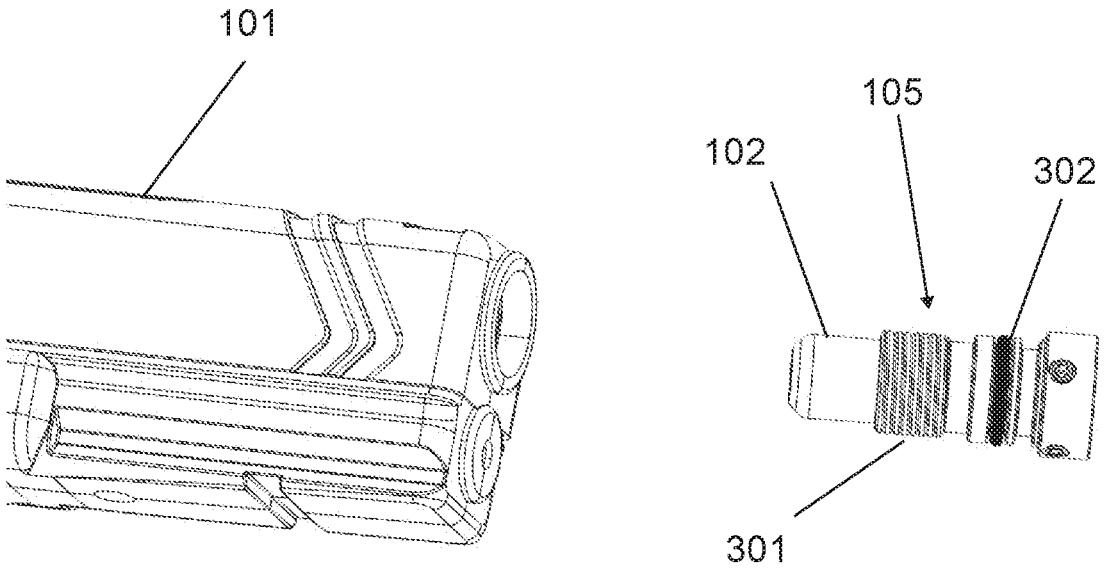
FIG. 3 illustrates a laser insert including a laser module coupled to an activation cap and a power source and disposed in a retainer disposable in a barrel of a simulative training firearm according to an exemplary embodiment of the present invention.
Figure 4:
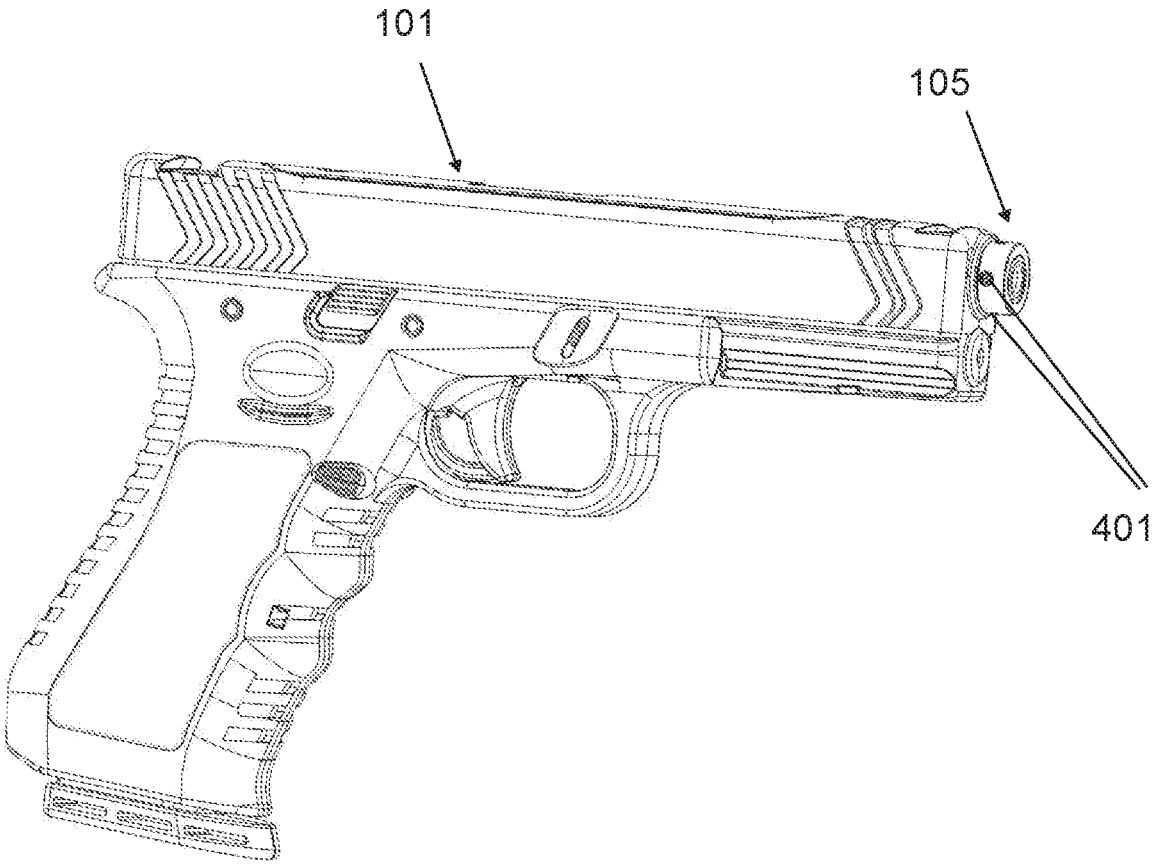
FIG. 4 illustrates a laser insert disposed in a barrel of a simulative training firearm according to an exemplary embodiment of the present invention.
Figure 5:
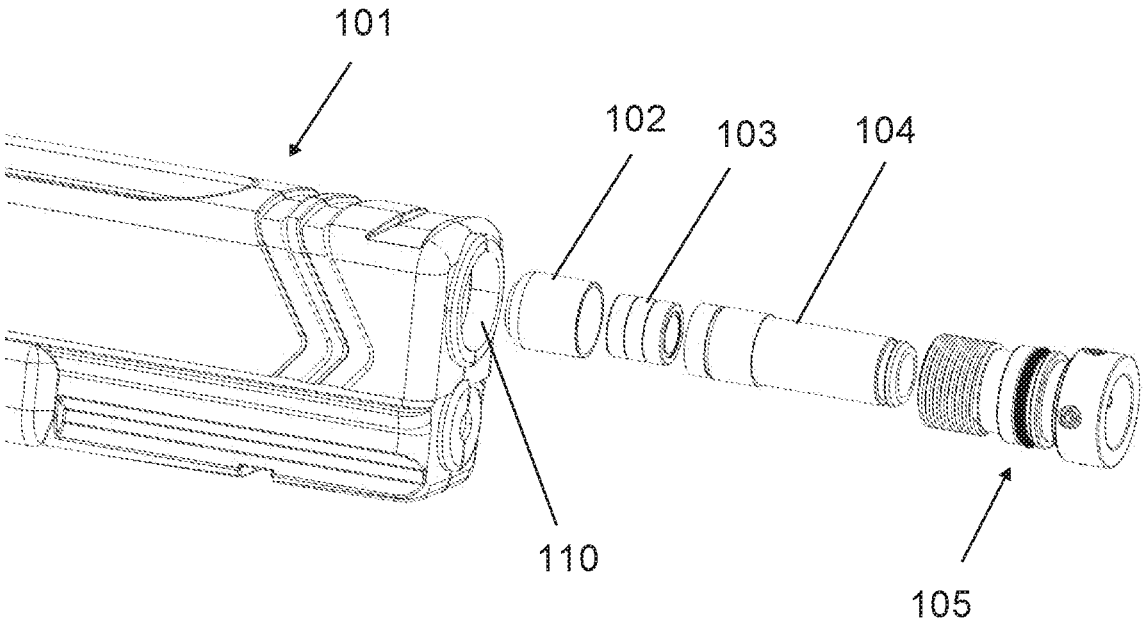
FIG. 5 illustrates a laser insert including a modular activation cap, power source, laser module and retainer, and a simulative training firearm according to an exemplary embodiment of the present invention.
Figure 6:
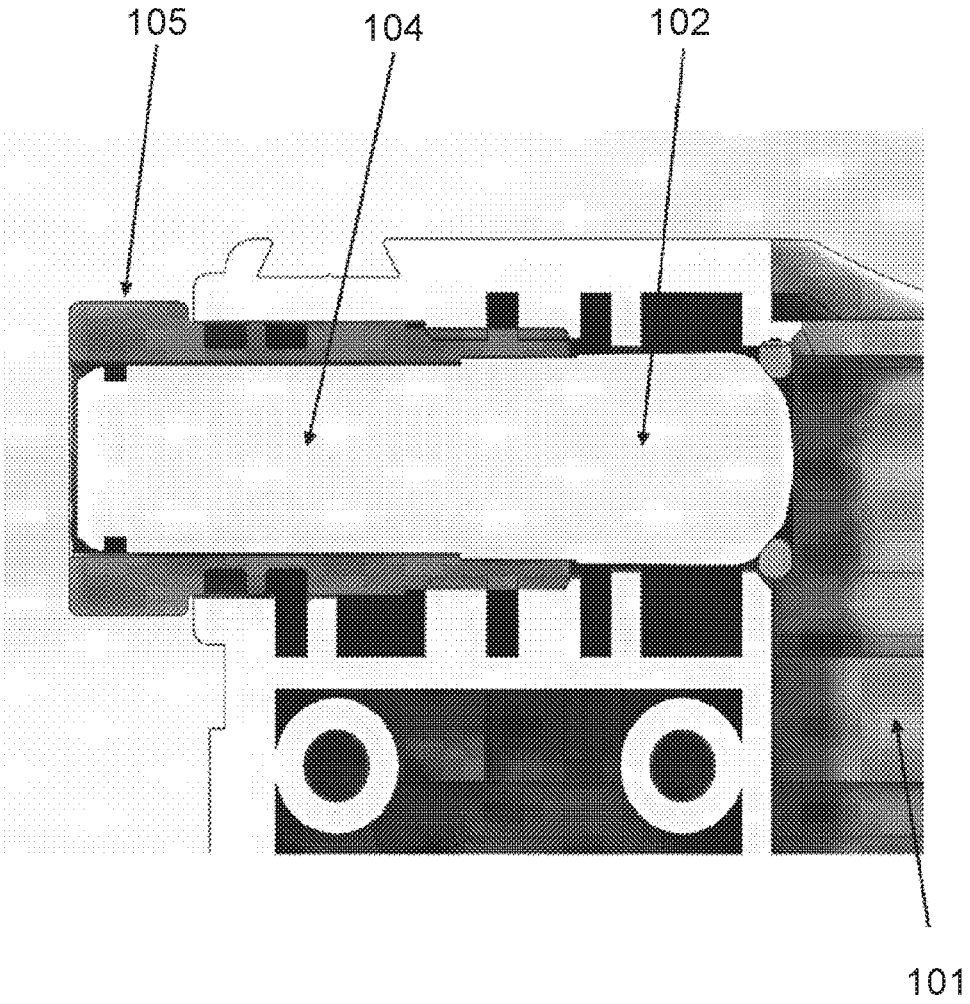
FIG. 6 is a cross sectional view illustrating a laser insert disposed in a barrel of a simulative training firearm according to an exemplary embodiment of the present invention.

FIG. 1 illustrates a laser insert including a modular activation cap, power source, laser module and retainer according to an exemplary embodiment of the present invention. FIG. 2 illustrates a laser insert including a laser module coupled to an activation cap and a power source, and a retainer according to an exemplary embodiment of the present invention. FIG. 3 illustrates a laser insert including a laser module coupled to an activation cap and a power source and disposed in a retainer disposable in a barrel of a simulative training firearm according to an exemplary embodiment of the present invention. FIG. 4 illustrates a laser insert disposed in a barrel of a training firearm according to an exemplary embodiment of the present invention. FIG. 5 illustrates a laser insert including a modular activation cap, power source, laser module and retainer, and a simulative training firearm according to an exemplary embodiment of the present invention. FIG. 6 is a cross sectional view illustrating a laser insert disposed in a barrel of a simulative training firearm according to an exemplary embodiment of the present invention.

Referring to FIGS. 1-6, a laser insert 100 may include an activation cap 102, a power source 103 (e.g., a battery), a laser module 104 and a retainer 105. The retainer 105 may be configured to couple the laser insert 100 to a simulative training firearm 101. The retainer 105 may include an attachment part 301 and an O-ring 302. The attachment part 301 may be a threaded cylinder configured to be threaded into the simulative training firearm 101.

The laser module 104 may emit a beam of light in response to a signal received from the activation cap 102. The activation cap 102 may receive an activation signal from the simulative training firearm 101. The simulative training firearm 101 may include a light emitting device, such as a light emitting diode (LED). The LED of the simulative training firearm 101 may be activated when a trigger mechanism of the simulative training firearm 101 is activated, thus emitting a beam of light to the activation cap 102. The activation cap 102 may include a photo transistor (see, e.g., FIG. 9), and the photo transistor may be in communication with a printed circuit board (PCB) disposed in the activation cap 102. The photo transistor of the activation cap 102 may receive the activation signal (e.g., the emitted beam of light) from the LED of the simulative training firearm 101 and may control the laser module 104 to emit one or more laser beams in response to the received signal. Thus, the activation cap 102 may communicate optically with the simulative training firearm 101 without being electrically connected or hard wired to the simulative training firearm 101.

The light emitting device of the simulative training firearm 101 may emit an infrared (IR) light to the activation cap 102, however, exemplary embodiments of the present invention are not limited thereto. For example, the light emitting device of the training firearm 101 may emit visible light, ultraviolet (UV) light or any other type of desired optical signal.

The laser module 104 may emit an infrared (IR) light toward a desired target, however, exemplary embodiments of the present invention are not limited thereto. For example, the laser module 104 may emit visible light, ultraviolet (UV) light or any other type of desired optical signal, such as any optical signal communicating with a training system configured to detect such an optical signal. For example, a particular simulative fire training system target may be configured to identify and the laser module 104 may be configured to emit one or more of different wavelengths of light, such as 635 nm light, 650 nm light, 780 nm light, 808 nm light, 850 nm light, 905 nm light and/or 980 nm light. However, exemplary embodiments of the present invention are not limited thereto, and the laser module 104 may emit light of any desired wavelength, and of any desired firing pattern, including any desired combination of light wavelengths, or pulse frequencies or patterns. Exemplary simulated fire training target systems are described below in more detail, which may be configured to detect and/or record various combinations of wavelengths of light, or pulse frequencies or patterns.

The wavelength of light emitted by the laser insert 100 may be determined by the laser module 104. The wavelength of light indicates the color of light emitted by the laser module 104. Different electronic targets and/or training simulators may be sensitive to/activated by different wavelengths of light. Changing the wavelength may occur by changing/swopping the laser module 104.

According to an exemplary embodiment of the present invention, each unique wavelength of light may be used to identify a particular shooter. Thus, a same laser insert 100 according to an exemplary embodiment of the present invention may be employed by multiple shooters, while maintaining the ability to distinguish between shooters. The different unique wavelengths of emitted light associated with unique individuals firing a simulative training firearm 101 may be emitted in response to a signal from the activation cap 102. Thus, the activation cap 102 may control the pulse firing patterns (e.g., emitted light firing patterns) of the laser module 104. Exemplary identification procedures for different individuals firing the training firearm are described below in more detail.

Figure 9:
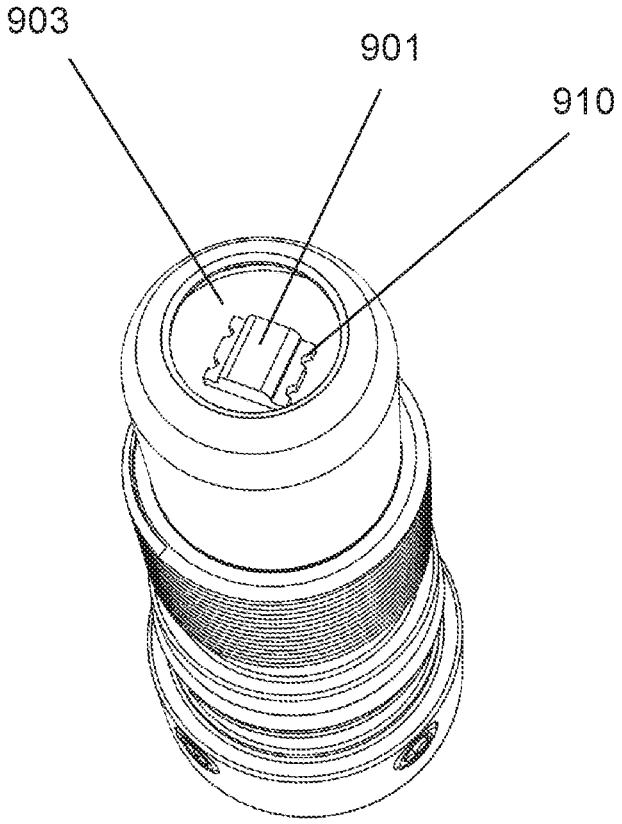
FIG. 9 illustrates a phototransistor disposed in an activation cap according to an exemplary embodiment of the present invention.

The activation cap 102 according to an exemplary embodiment of the present invention may include the printed circuit board (PCB) described in more detail below with reference, for example, the FIG. 9. The PCB may be in communication with the photo transistor. The activation cap 102 may include executable program instructions embodied therewith. The executable program instructions may cause the activation cap 102 to control the laser module 104 to emit any desired patterns of light (e.g., a pattern of light unique to a particular user). The activation cap 102 may receive, store or transmit binary code. Thus, the activation cap 102 may control the pulse firing behavior of the laser module 104.

According to an exemplary embodiment of the present invention, the activation cap 102 may directly control the laser module 104 (e.g., by activating or deactivating the power source 103 to provide power to or remove power from the laser module 104). The laser module 104 may be configured to emit a single wavelength of light when turned on by the activation cap. Thus, the laser module 104 may be configured to emit a single wavelength of light regardless of the number of times the laser module 104 is turned on/off, and the laser module 104 may be directly controlled by the activation cap 102.

The firing behavior of the laser module 104 may produce a laser binary code, which may be referred to as pulse control. The laser binary code may send information similar to Morse code by the laser module 104 being turned on and off. Thus, the transmission of a laser binary code from the laser insert 100 to a simulative training system or target may be controlled by the laser module 104 according to an exemplary embodiment of the present invention.

The laser module 104 may be turned on and off to emit a laser firing pattern. For example, laser modulation may refer to turning the laser module 104 on and off at a relatively constant rate, and the frequency of the emitted light may be measured according to how many on-off cycles are produced per second, however, exemplary embodiments of the present invention are not limited thereto and the pattern of light emitted by the laser module 104 may be varied, as desired. Laser modulation may be used to key the laser insert 100 for various electronic targets (e.g., simulative training targets or systems) that are sensitive to a particular frequency. Thus, laser modulation may be controlled by the laser module 104.

The activation cap 102 may control the pulse length of the laser insert 100. The pulse length may refer to the length of time that the laser module 104 is turned on or off. That is, the pulse length may refer to the length of time that a laser beam is emitted from the laser module 104. Varying the pulse length may produce different identifiable firing patterns according to exemplary embodiments of the present invention.

The simulative fire training device (e.g., simulative training firearm 101) according to an exemplary embodiment of the present invention may include the power source 103 (e.g., a battery) providing power (e.g., DC power) to the activation cap 102 and the laser module 104. The battery may be an alkaline battery, a rechargeable battery, a silver oxide battery, a lithium battery, a lead acid battery, a mercury free battery, an ISO 14000 compliant battery, or a lead free battery. The power source 103 may provide between approximately 1.5 volts and 6.0 volts of power. For example, the power supply may provide about 4.5 volts of power. However, exemplary embodiments of the present invention are not limited thereto and the power source may provide any desired range of power.

The retainer 105 may include the attachment part 301 and the O-ring 302. The attachment part 301 may couple the laser insert 100 to the simulative training firearm 101. The attachment part 301 may be threaded to correspond with a barrel 110 (e.g., a threaded barrel) of the simulative training firearm 101. The O-ring 302 may substantially seal a gap between the retainer 105 and the barrel 110 of the simulative training firearm 101 adjacent to a distal end of the simulative training firearm's barrel 110. Thus, the activation cap 102, the power source 103 and the laser module 104 may be disposed in the barrel 110 of the simulative training firearm 101, and may be held in place by the retainer 105.

The beam of light emitted from the laser module 104 may be substantially parallel to a central axis of the simulative training firearm 101. The laser insert 100 according to an exemplary embodiment of the present invention may include adjustment screws 401 (e.g., elevation and windage screws) adjustable for maintaining the parallel path of the emitted light. The adjustment screws 401 may simultaneously secure the laser module 104 to the retainer 105, and may be used to adjust the direction of the laser beam emitted by the laser module 104. That is, the adjustment screws 401 (e.g., elevation and windage screws) may serve a dual function of securing the laser module 104 to the retainer 105, and minutely adjusting the path of the laser beam emitted by the laser module 104. Thus, accuracy of the emitted laser beam may be maintained even when the laser insert 100 is repeatedly removed and re-installed in the barrel 110 of the simulative training firearm 101.

The laser insert 100 may be modular and thus the activation cap 102, the power source 103 (e.g., a battery), the laser module 104 and the retainer 105 may detach from each other. The modular components (e.g., the activation cap 102 and/or the laser module 104) may be selectively replaced and thus different functionality may be achieved without replacing the entire laser insert 100. For example, a plurality of laser modules according to an exemplary embodiment of the present invention may each be configured to emit a different wavelength of light. Each of the different wavelengths of light may be associated with a different individual operating the simulative training firearm 101, and thus replacing the laser module 104 without replacing any of the other modular components may be used to identify a particular user of the simulative training firearm 101. The same activation cap 102 according to an exemplary embodiment of the present invention may be used, but may include executable program instructions according to an exemplary embodiment of the present invention which instruct the same laser module 104 to fire with a distinctive light firing pattern.

Any desired combination of the activation cap 102 and/or the laser module 104 according to exemplary embodiments of the present invention may be employed to generate distinctive user identification patterns. Thus, as described below in more detail, the laser insert 100 according to exemplary embodiments of the present invention may be used with substantially any training target system, and multiple individuals using the simulative training firearm 101 may be identified.

The retainer 105 may secure the laser insert 100 including the laser module 104 and the activation cap 102 according to an exemplary embodiment of the present invention to the simulative training firearm 101. The simulative training firearm 101 may include a printed circuit board (PCB) controlling a light emitting device, such as an infrared LED (see, e.g., the training firearm light emitting device 801 described in more detail below with reference to FIG. 8). The simulative training firearm 101 including the printed circuit board (PCB) controlling the light emitting device may communicate optically with the laser insert 100 according to an exemplary embodiment of the present invention.

Figure 7:
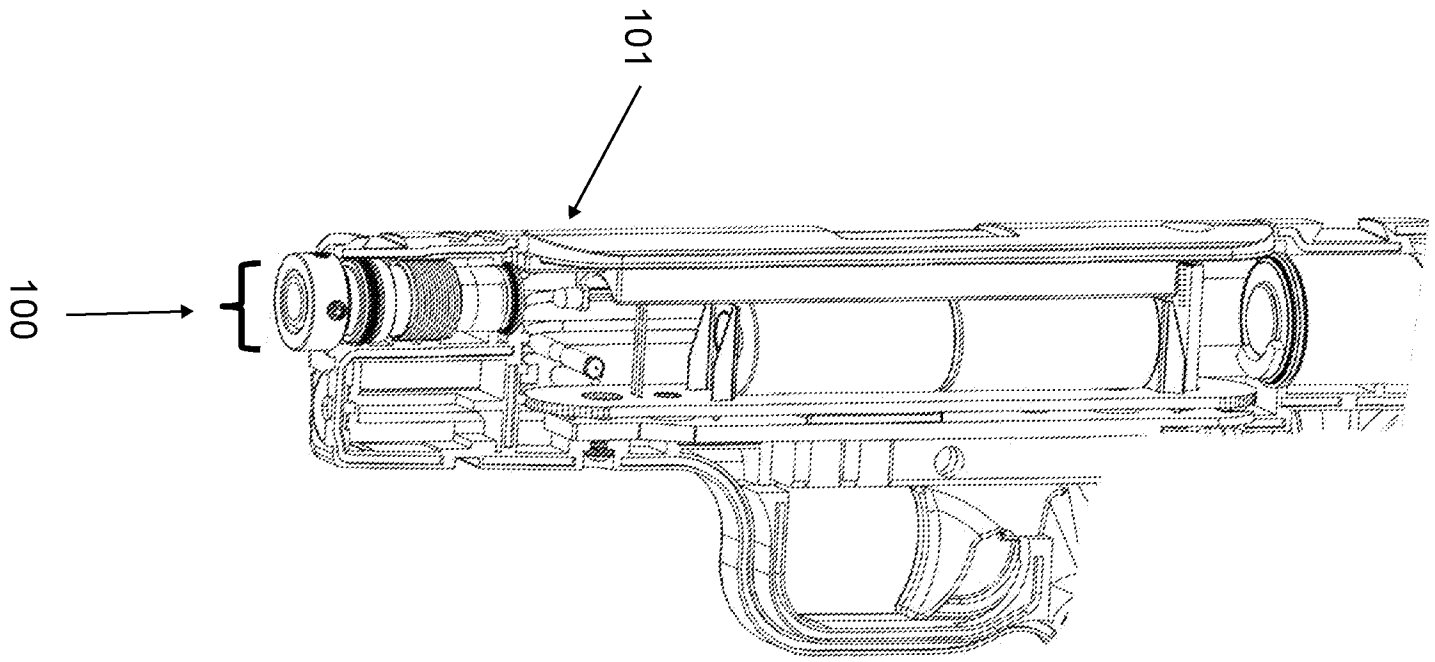
FIG. 7 is a side view illustrating a simulative training firearm and a laser insert disposed in a barrel of the simulative training firearm according to an exemplary embodiment of the present invention.

FIG. 7 is a side view illustrating a simulative training firearm and a laser insert disposed in a barrel of the simulative training firearm according to an exemplary embodiment of the present invention.

Referring to FIG. 7, the laser insert 100 may be disposed in the barrel of the simulative training firearm 101.

Figure 8:
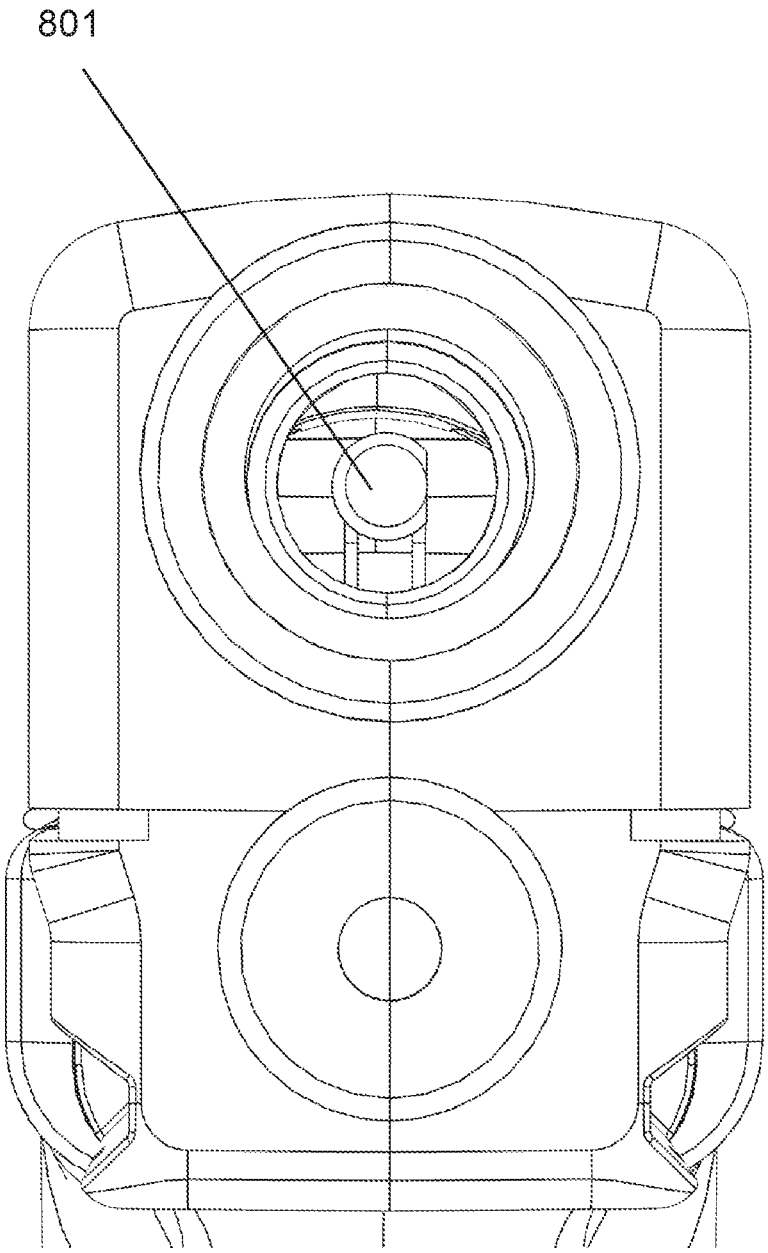
FIG. 8 is a front view of a simulative training firearm illustrating a simulative training firearm light emitting device according to an exemplary embodiment of the present invention.
Figure 10:
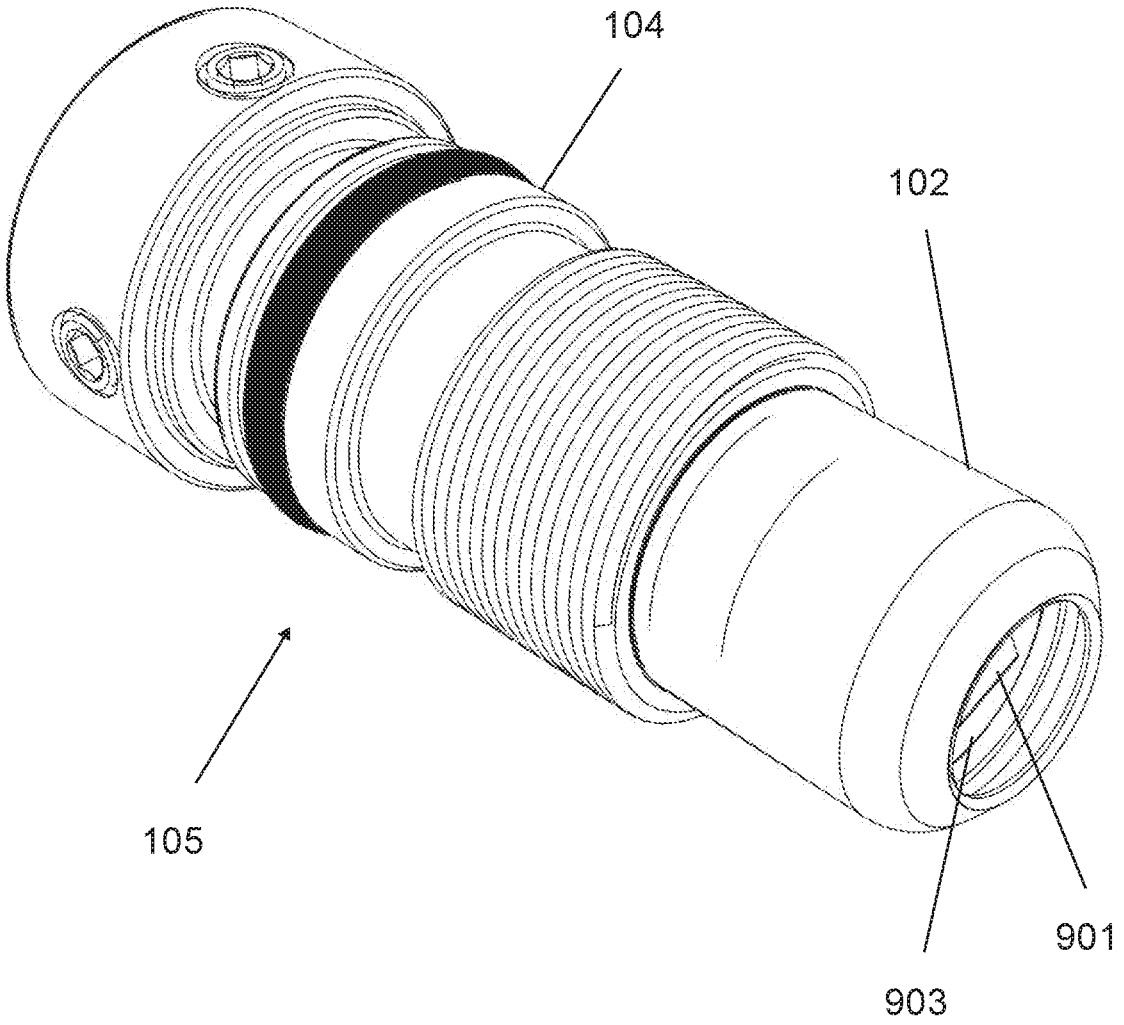
FIG. 10 is a perspective view of a laser insert according to an exemplary embodiment of the present invention.

FIG. 8 is a front view of a simulative training firearm illustrating a simulative training firearm light emitting device according to an exemplary embodiment of the present invention. FIG. 9 illustrates a phototransistor disposed in an activation cap according to an exemplary embodiment of the present invention. FIG. 10 is a perspective view of a laser insert according to an exemplary embodiment of the present invention.

The simulative training firearm 101 according to an exemplary embodiment of the present invention may include a simulative training firearm light emitting device 801. The simulative training firearm light emitting device 801 may include a light emitting diode (LED). The simulative training firearm light emitting device 801 may emit an optical signal to the activation cap 102 in response to activation of a trigger mechanism on the simulative training firearm 101. The activation cap 102 may receive the optical signal and may instruct the laser module 104 to emit a laser beam.

The activation cap 102 according to an exemplary embodiment of the present invention may include a photo transistor 901 and a printed circuit board (PCB) 910. The photo transistor 901 may be disposed on and/or electrically connected to the printed circuit board (PCB) 910. The photo transistor 901 may be exposed through a hole 903 disposed in a surface of the activation cap 102 facing the simulative training firearm light emitting device 801. Thus, the simulative training firearm 101 may optically trigger the activation cap 102 to control the laser module 104 to emit the beam of light according to exemplary embodiments of the present invention.

The training firearm light emitting device 801 may emit, and the activation cap 102 may receive, an infrared (IR) signal, however, exemplary embodiments of the present invention are not limited thereto. For example, the training firearm light emitting device 801 may emit, and the activation cap 102 may receive, visible light, ultraviolet (UV) light or any other type of desired optical signal. Thus, the simulative training firearm 101 and the activation cap 102 may communicate optically, without being electrically or mechanically connected to each other.

The simulative training firearm 101 according to an exemplary embodiment of the present invention may send a coded light instruction to the activation cap 102 by different pulse length or by binary code. The activation cap 102 may react differently to different received codes, such as different coded light instruction or different binary codes.

According to an exemplary embodiment of the present invention, the light emitted by the simulative training firearm 101 may be encoded and the activation cap 102 may respond to the encoded light. For example, the activation cap 102 may be configured to respond to a particular number of pulses of light, or a particular pattern of light. The encoding of the emitted or received light may include any desired coding pattern. The activation cap 102 may interpret the encoded light signal and may control the laser module 104 to emit a particular pattern of light in response to the encoded light signal.

The activation cap 102 may include executable program instructions embodied therewith. The executable program instructions may interpret the encoded light signal received from the simulative training firearm 101. The executable program instructions may cause the activation cap 102 to control the laser module 104 to emit any desired patterns of light (e.g., a pattern of light unique to a particular user). The activation cap 102 may receive, store or transmit binary code. Thus, the activation cap 102 may control the pulse firing behavior of the laser module 104.

Figure 11:
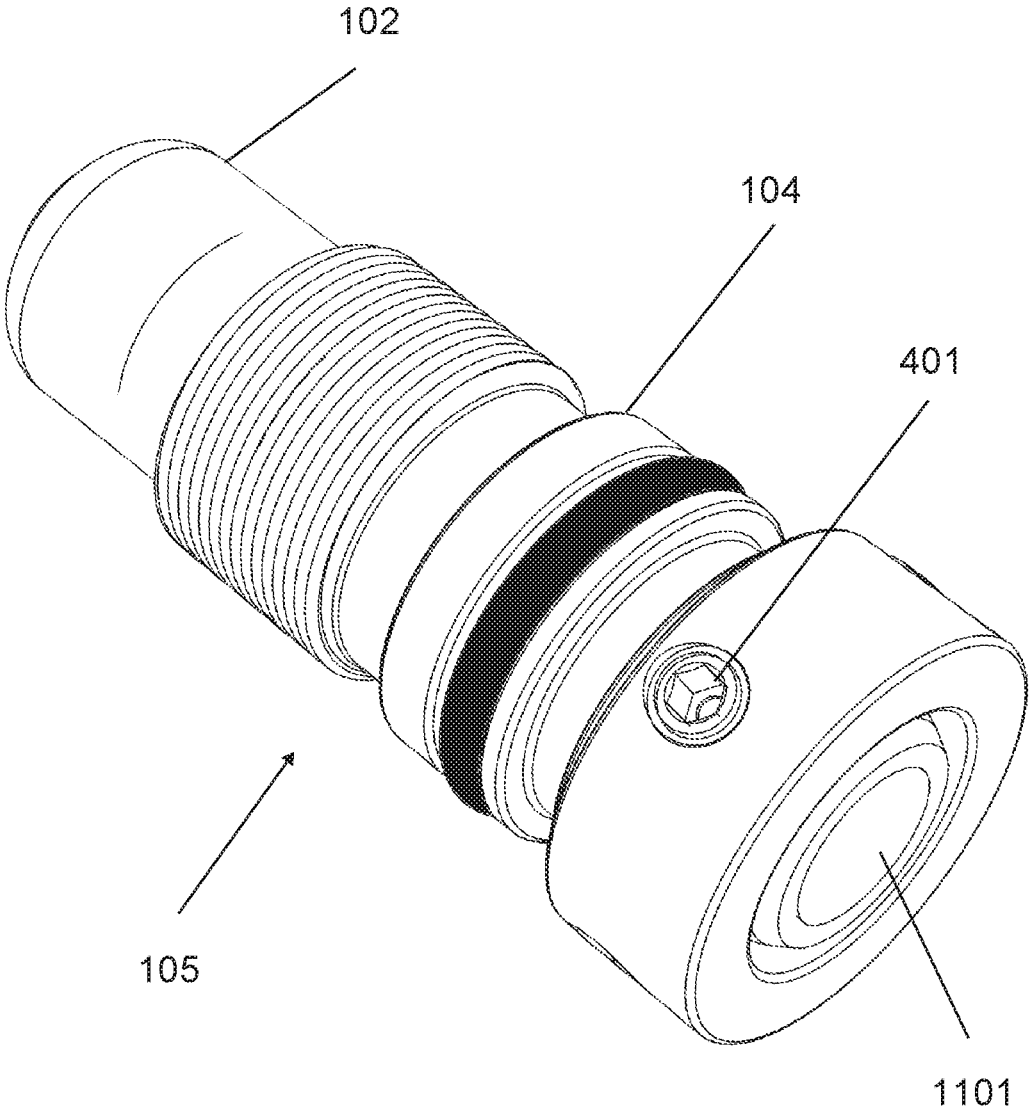
FIG. 11 is a perspective view of a laser insert according to an exemplary embodiment of the present invention.

FIG. 11 is a perspective view of a laser insert according to an exemplary embodiment of the present invention.

Referring to FIG. 11, the retainer 105 may include an exit hole 1101. The exit hole 1101 may face away from the barrel 110 of the simulative training firearm 101. The laser insert 100 according to an exemplary embodiment of the present invention may include the adjustment screws 401 (e.g., elevation and windage screws) adjustable for maintaining a direction of light emitted through the exit hole 1101. The adjustment screws 401 may simultaneously secure the laser module 104 to the retainer 105, and may be used to adjust the direction of the laser beam emitted by the laser module 104. That is, the adjustment screws 401 (e.g., elevation and windage screws) may serve a dual function of securing the laser module 104 to the retainer 105, and minutely adjusting the path of the laser beam emitted by the laser module 104. Thus, accuracy of the emitted laser beam emitted from the laser module 104 through the exit hole 1101 may be maintained even when the laser insert 100 is repeatedly removed and re-installed in the barrel 110 of the simulative training firearm 101.

Figure 12:
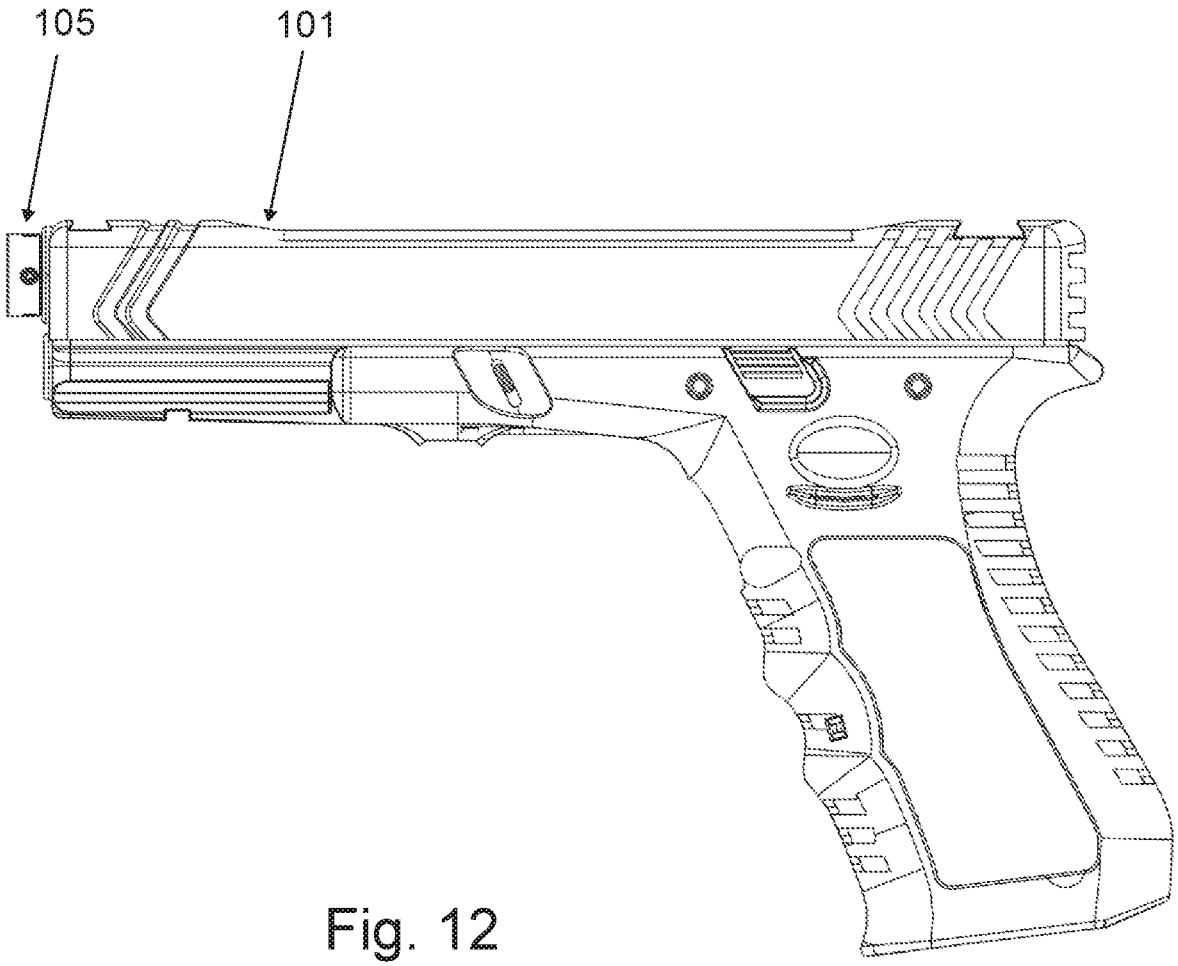
FIG. 12 is a side view illustrating a simulative training firearm and a laser insert disposed in a barrel of the simulative training firearm according to an exemplary embodiment of the present invention.

FIG. 12 is a side view illustrating a simulative training firearm and a laser insert disposed in a barrel of the training firearm according to an exemplary embodiment of the present invention.

Referring to FIG. 12, a portion of the retainer 105 may be exposed when the laser insert according to an exemplary embodiment of the present invention is disposed in the barrel 110 of the simulative training firearm 101. Thus, the adjustment screws 401 may be exposed and accessible, even when the laser insert according to an exemplary embodiment of the present invention is disposed in the barrel 110 of the simulative training firearm 101.

Figure 13:
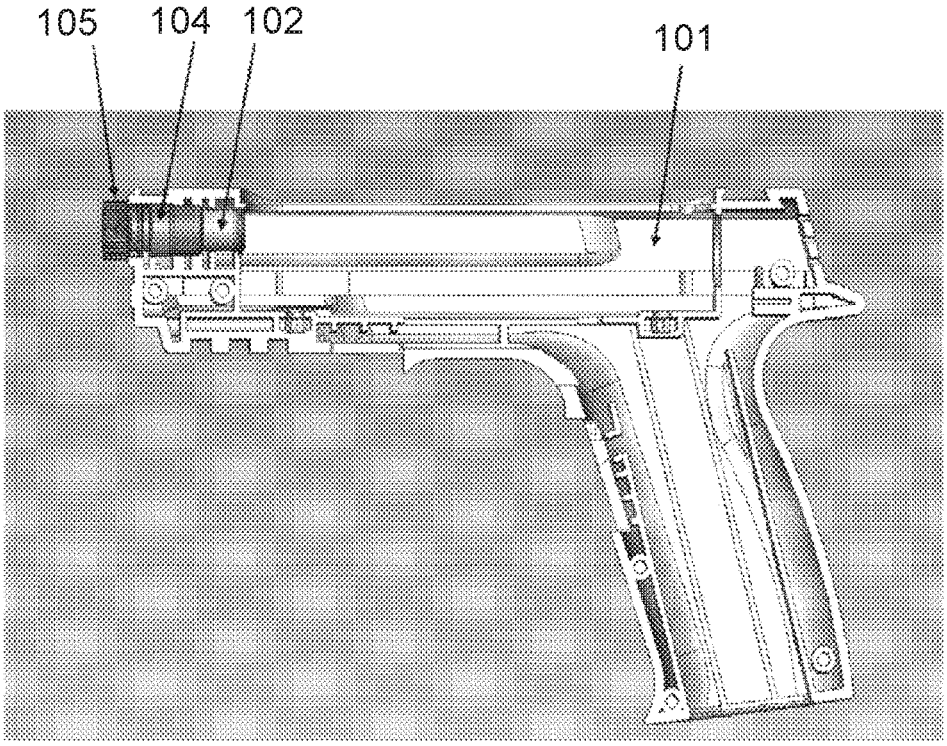
FIG. 13 is an internal side view of a right side a simulative training firearm and a laser insert disposed in a barrel of the simulative training firearm according to an exemplary embodiment of the present invention.
Figure 14:
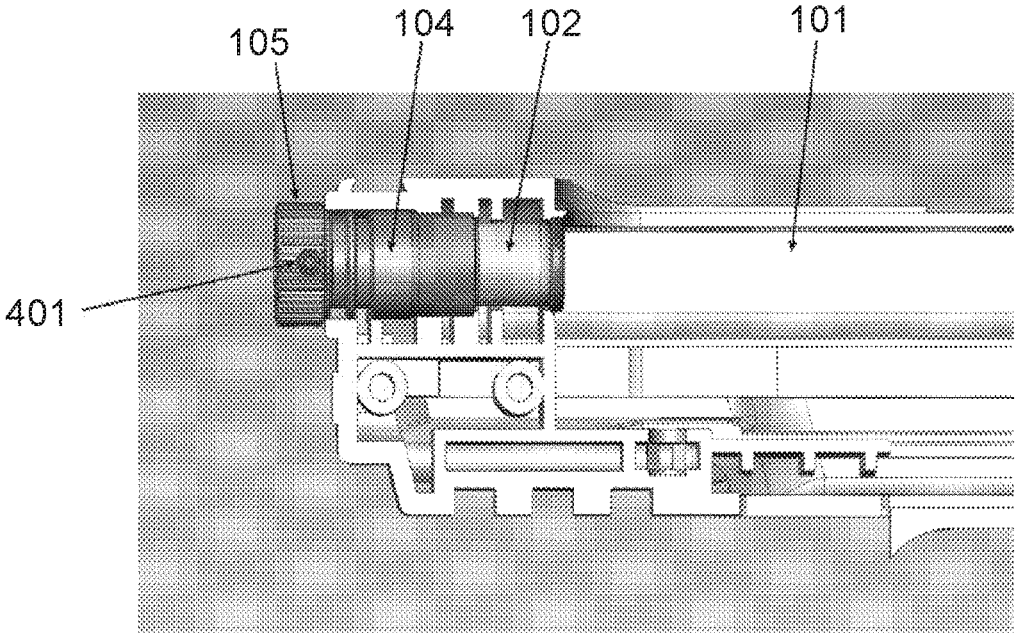
FIG. 14 is an internal side view of a laser insert disposed in a barrel of a simulative training firearm according to an exemplary embodiment of the present invention.

FIG. 13 is an internal side view of a right side a simulative training firearm and a laser insert disposed in a barrel of the simulative training firearm according to an exemplary embodiment of the present invention. FIG. 14 is an internal side view of a laser insert disposed in a barrel of a simulative training firearm according to an exemplary embodiment of the present invention.

Referring to FIGS. 13 and 14, the laser insert 100 including the activation cap 102 and the laser module 104 may be secured in the barrel 110 of the simulative training firearm 101 by the retainer 105, while leaving the adjustment screws 401 exposed.

Figure 15:
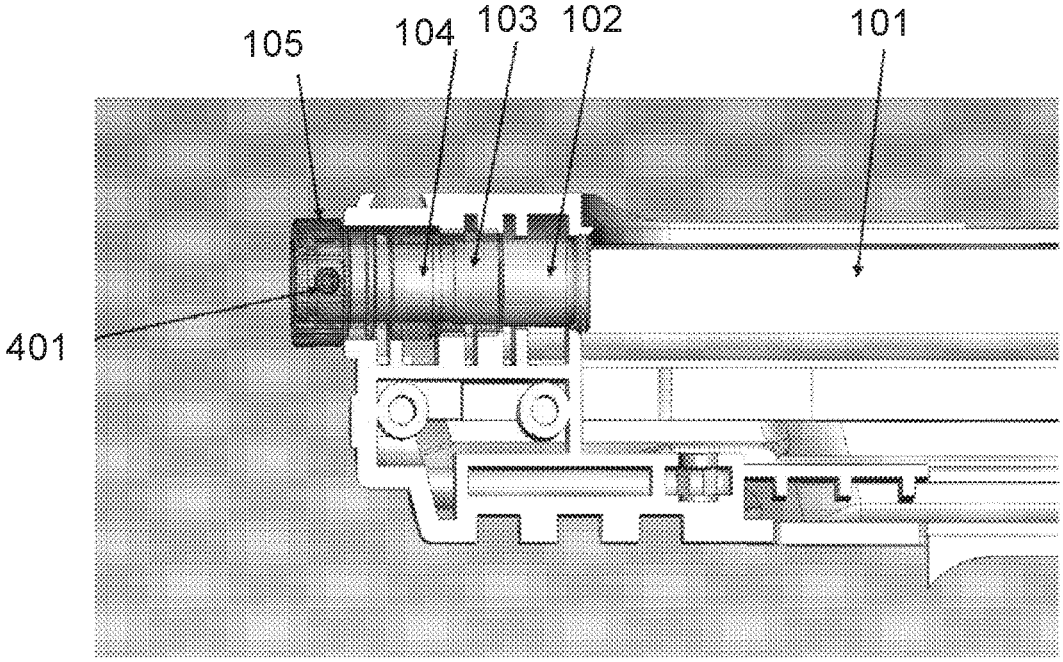
FIG. 15 is an internal side view of a laser insert disposed in a barrel of a simulative training firearm according to an exemplary embodiment of the present invention.

FIG. 15 is an internal side view of a laser insert disposed in a barrel of a simulative training firearm according to an exemplary embodiment of the present invention.

Referring to FIG. 15, the laser insert 100 including the activation cap 102 and the laser module 104 may be secured in the barrel 110 of the simulative training firearm 101 by the retainer 105, while leaving the adjustment screws 401 exposed. The laser insert 100 may include the power source 103 disposed between the laser module 104 and the activation cap 102.

Figure 16:
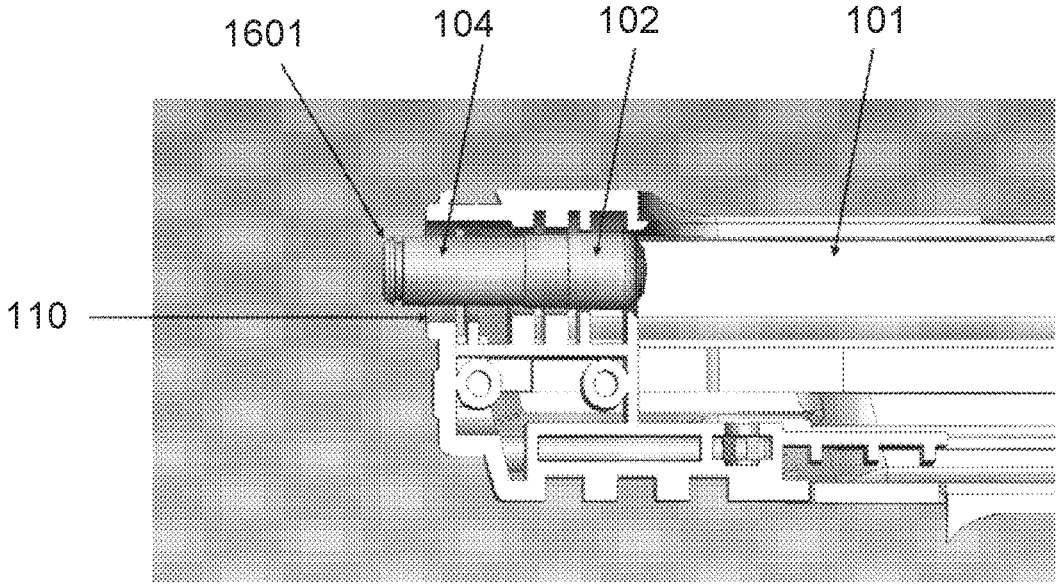
FIG. 16 is an internal side view of a laser insert disposed in a barrel of a simulative training firearm according to an exemplary embodiment of the present invention.

FIG. 16 is an internal side view of a laser insert disposed in a barrel of a simulative training firearm according to an exemplary embodiment of the present invention.

Referring to FIG. 16 the laser module 104 may include an attachment part 1601 connecting the laser module 104 to the retainer 105. The attachment part 1601 may protrude from the barrel 110 of the simulative training firearm 101. The adjustment screws 401 may contact the attachment part 1601 to secure the laser module 104 to the retainer 105.

Figure 17:
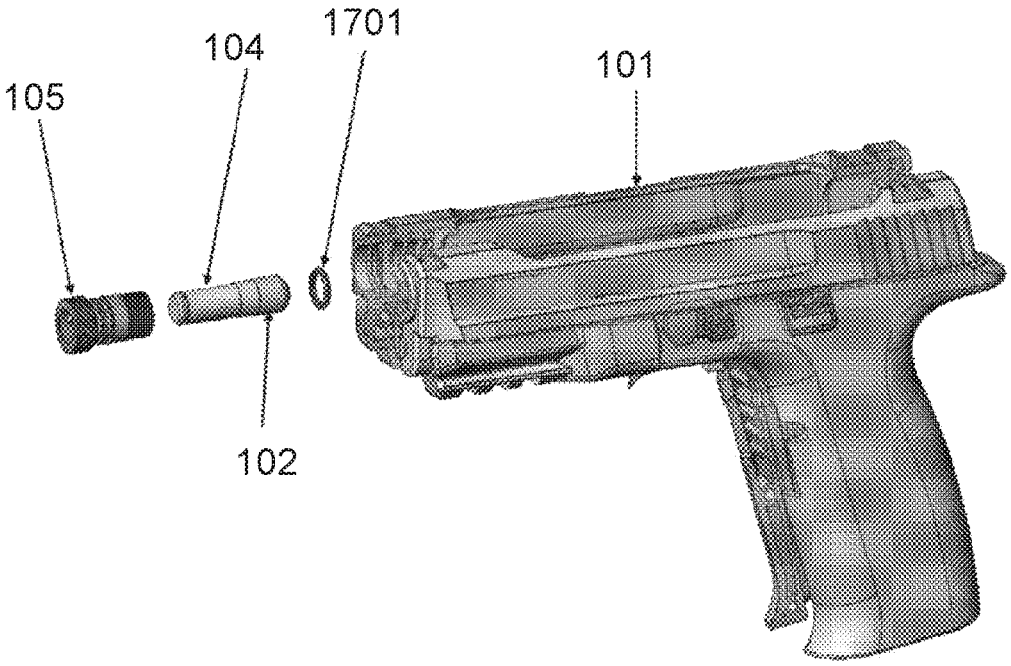
FIG. 17 is an exploded perspective view of a laser insert and a simulative training firearm according to an exemplary embodiment of the present invention.

FIG. 17 is an exploded perspective view of a laser insert and a simulative training firearm according to an exemplary embodiment of the present invention.

Referring to FIG. 17, an internal O-ring 1701 may be disposed in the barrel 110 of the simulative training firearm 101 between the activation cap 102 and the barrel 110 of the simulative training firearm 101. The internal O-ring 1701 may maintain the position of the activation cap 102 with respect to the training firearm light emitting device 801. The internal O-ring 1701 may be coupled to the activation cap 102.

The internal O-ring 1701 may be compressed against the activation cap 102 of the laser insert 100, thus creating a mechanical pressure forward (e.g., similar to a spring) toward the distal end of the barrel 110 of the simulative training firearm 101. The internal O-ring 1701 may stabilize the laser insert 100 in the barrel 110 and may provide support during alignment of the laser module 104 with the alignment screws 401.

Figure 18:
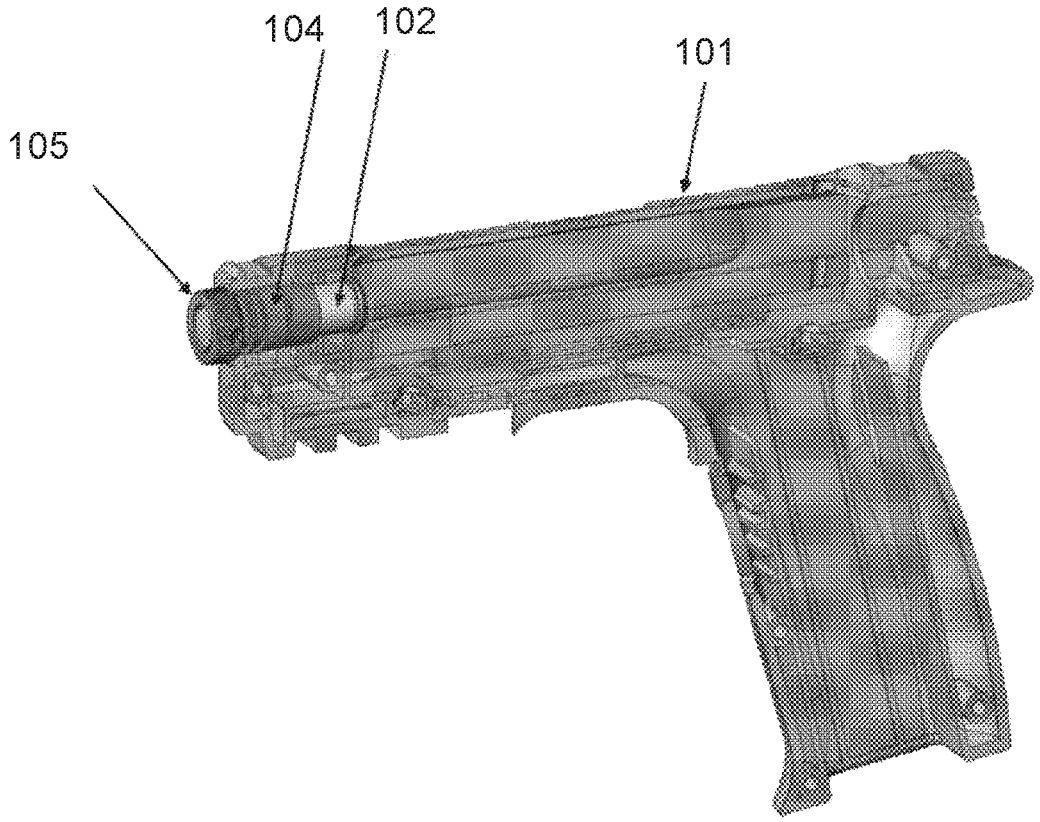
FIG. 18 is an internal perspective view of a laser insert disposed in a barrel of a simulative training firearm according to an exemplary embodiment of the present invention.
Figure 19:
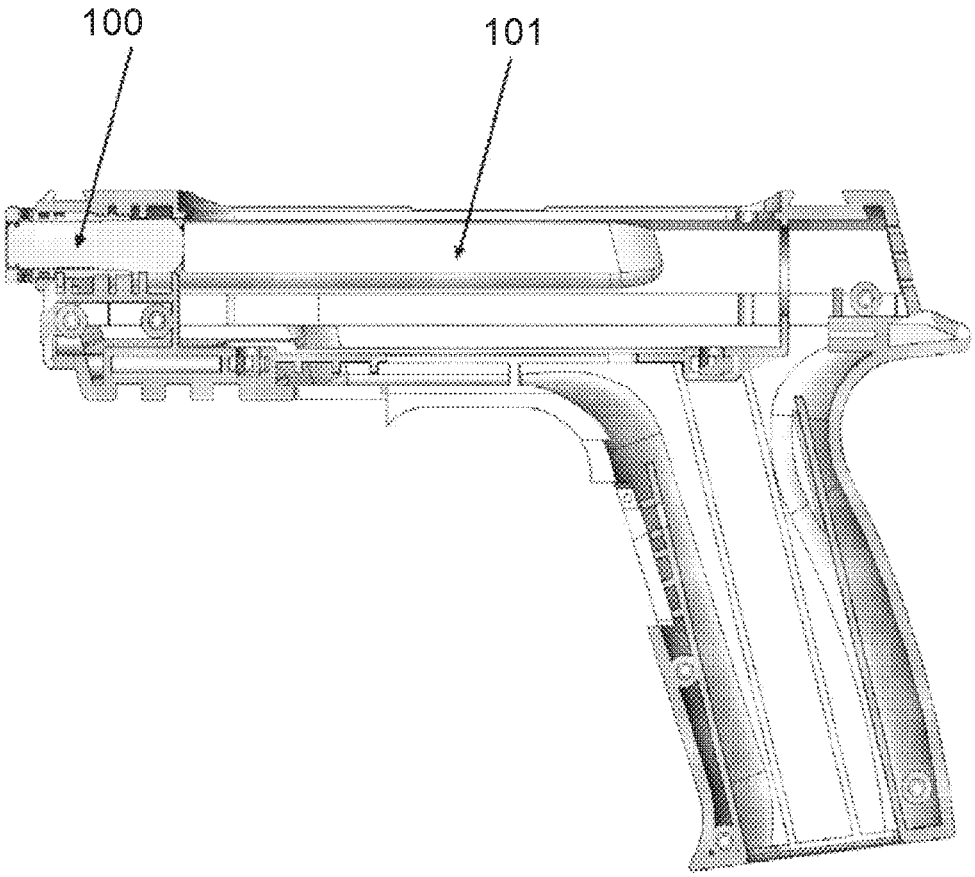
FIG. 19 is an internal side view of a laser insert disposed in a barrel of a simulative training firearm according to an exemplary embodiment of the present invention.
Figure 20:
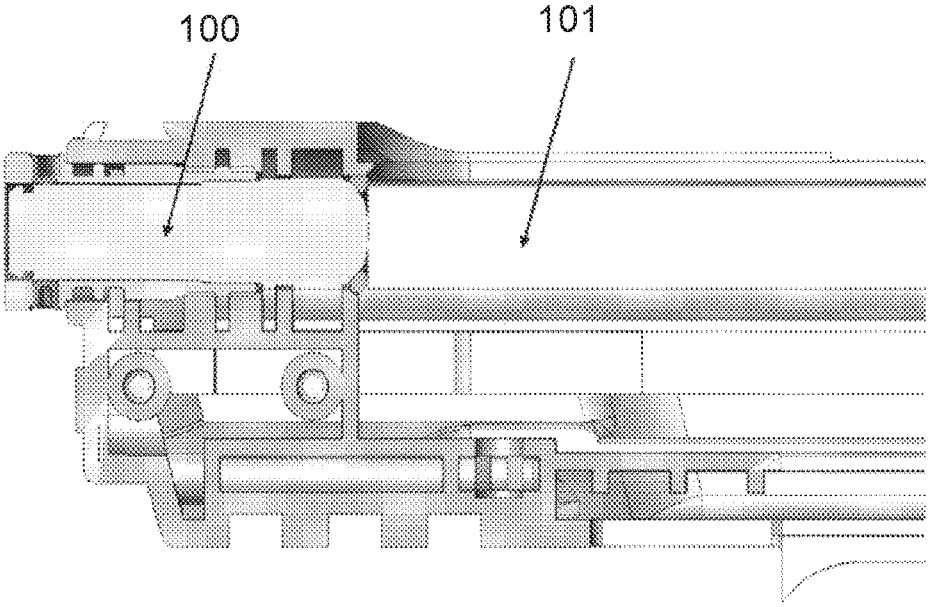
FIG. 20 is an internal side view of a laser insert disposed in a barrel of a simulative training firearm according to an exemplary embodiment of the present invention.

FIG. 18 is an internal perspective view of a laser insert disposed in a barrel of a simulative training firearm according to an exemplary embodiment of the present invention. FIG. 19 is an internal side view of a laser insert disposed in a barrel of a simulative training firearm according to an exemplary embodiment of the present invention. FIG. 20 is an internal side view of a laser insert disposed in a barrel of a simulative training firearm according to an exemplary embodiment of the present invention.

Referring to FIGS. 18-20, the laser insert 100 including the activation cap 102 and the laser module 104 may be secured in the barrel 110 of the simulative training firearm 101 by the retainer 105, while leaving the adjustment screws 401 exposed.

The laser insert according to an exemplary embodiment of the present invention may be used with substantially any simulative fire training or target system, such as substantially any simulative fire training or target system configured to detect infrared, visible, ultraviolet light, or substantially any detectable light signal. Different simulative fire training systems may be configured to detect particular wavelengths of light or particular light firing patterns. The laser insert according to an exemplary embodiment of the present invention is adaptable to be used with substantially any simulative fire training system or any simulative fire target system. For example, activations caps and/or laser modules keyed to a particular simulative fire training or target system may be included in the laser insert according to an exemplary embodiment of the present invention. The modularity of the laser insert according to exemplary embodiments of the present invention may be employed to swap out activation caps and/or laser modules which are keyed to particular simulative fire training systems.

The laser module according to an exemplary embodiment of the present invention may emit an infrared (IR) light toward a desired target, however, exemplary embodiments of the present invention are not limited thereto. For example, the laser module may emit visible light, ultraviolet (UV) light or any other type of desired optical signal, such as any optical signal communicating with a training system configured to detect such an optical signal. For example, a particular simulative fire training system target may be configured to identify one or more of different wavelengths of light, such as 635 nm light, 650 nm light, 780 nm light, 808 nm light, 850 nm light, 905 nm light and/or 980 nm light. However, exemplary embodiments of the present invention are not limited thereto, and the laser module may emit light of any desired wavelength, and of any desired firing pattern, including any desired combination of light wavelengths, or pulse frequencies or patterns.

Thus, the laser insert according to exemplary embodiments of the present invention may reduce or eliminate the use of unique or particular simulative training firearms with a particular simulative fire training system.

According to an exemplary embodiment of the present invention, the same simulative training firearm may be identifiably used by different individuals. For example, the simulative training firearm may be used with any desired simulative fire training or target system and each individual firing the simulative training firearm may be determined by the simulative fire training or target system. The laser insert may emit a laser beam or light signal having any desired wavelength detectable by the simulative fire training or target system. A unique pattern of light may be emitted for each individual including, for example, variable light pulse lengths, light having a unique wavelength or combination of wavelengths or any other desired light fire pattern. Thus, a unique user ID may be generated for each individual using the same simulative training firearm.

The activation cap according to an exemplary embodiment of the present invention may control the laser module to emit different pulse firing patterns that are unique to a particular user, such as a burst of short beams of light, or a unique burst of a combination of short and long beams of light. The activation cap may control the laser module to emit signals having different pulse lengths or a different frequency modulation. Thus, a same laser insert according to an exemplary embodiment of the present invention may be employed by multiple shooters, while maintaining the ability to distinguish between shooters. The different unique wavelengths of emitted light associated with unique individuals firing a simulative training firearm may be emitted in response to a signal from the activation cap. Thus, the activation cap may control the pulse firing patterns (e.g., emitted light firing patterns) of the laser module according to an exemplary embodiment of the present invention.

Having described exemplary embodiments of the present invention, it is further noted that it is readily apparent to those of ordinary skill in the art that various modifications may be made without departing from the scope of the present invention.

What is claimed is:

1. A laser projection insert, comprising:

a laser module wherein the laser module is a modular component, whereby the laser module can be selectively replaced to thereby emit different light wavelengths and/or light patterns without replacing the entire laser insert;

an activation cap configured to receive an optical signal from a training pistol or a simulative training firearm, and configured to control the laser module to emit light, wherein the activation cap is a modular component, whereby the activation cap can be selectively replaced to thereby transmit different pulse patterns without replacing the entire laser insert; and a power source disposed between the activation cap and the laser module, wherein the insert is disposable in a chamber of a training firearm.

2. The laser projection insert of claim 1, wherein the activation cap comprises a photo transistor that is configured to detect infrared, ultraviolet or visible light emitted from the simulative training firearm.

3. The laser projection insert of claim 2, wherein the photo transistor is exposed to an outside of the activation cap by a hole in the activation cap.

4. The laser projection insert of claim 1, wherein the laser module is configured to emit infrared, ultraviolet or visible light.

5. The laser projection insert of claim 1, wherein the laser module is configured to emit light having a wavelength of from about 635 nm to about 980 nm.

6. The laser projection insert of claim 1, wherein the activation cap is coupled to the laser module.

7. The laser projection insert of claim 1, wherein the activation cap is electrically connected to the laser module through the power source.

8. The laser projection insert of claim 1, wherein the activation cap comprises executable program instructions.

9. The laser projection insert of claim 8, wherein the executable program instructions may interpret an encoded light signal.

10. The laser projection insert of claim 1, wherein the activation cap is configured to receive binary code.

11. The laser projection insert of claim 1, wherein the activation cap is configured to store binary code.

12. The laser projection insert of claim 1, wherein the activation cap is configured to transmit binary code.

* * * * *